US007167070B2

(12) United States Patent
Tanaka et al.

(10) Patent No.: US 7,167,070 B2
(45) Date of Patent: Jan. 23, 2007

(54) LAMINATED COIL COMPONENT AND METHOD OF PRODUCING THE SAME

(75) Inventors: Hiroshi Tanaka, Sagamihara (JP); Takahiro Yamamoto, Otsu (JP); Hajime Arakawa, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/527,036

(22) PCT Filed: Jun. 22, 2004

(86) PCT No.: PCT/JP2004/008753

§ 371 (c)(1),
(2), (4) Date: Mar. 8, 2005

(87) PCT Pub. No.: WO2005/024863

PCT Pub. Date: Mar. 17, 2005

(65) Prior Publication Data

US 2006/0152319 A1 Jul. 13, 2006

(30) Foreign Application Priority Data

Sep. 1, 2003 (JP) ..... 2003-309027

(51) Int. Cl.
*H01F 5/00* (2006.01)

(52) U.S. Cl. ..... 336/200; 336/232; 336/223; 29/602.1

(58) Field of Classification Search ..... 336/200, 336/223, 232; 29/602.1
See application file for complete search history.

(56) References Cited

U.S. PATENT DOCUMENTS

| | | | | |
|---|---|---|---|---|
| 5,404,118 | A * | 4/1995 | Okamura et al. | 333/175 |
| 5,985,414 | A * | 11/1999 | Fukuda et al. | 428/192 |
| 6,249,205 | B1 * | 6/2001 | Meadors et al. | 336/200 |
| 6,304,164 | B1 * | 10/2001 | Ohno et al. | 336/200 |
| 6,407,343 | B1 * | 6/2002 | Tanaka | 174/261 |

FOREIGN PATENT DOCUMENTS

| | | |
|---|---|---|
| JP | 61-96548 | 6/1986 |
| JP | 9-92753 | 4/1997 |
| JP | 2000-150241 | 5/2000 |
| JP | 2002-252117 | 9/2002 |
| JP | 2003-17325 | 1/2003 |

* cited by examiner

*Primary Examiner*—Anh Mai
(74) *Attorney, Agent, or Firm*—Keating & Bennett, LLP

(57) ABSTRACT

A laminated coil is constructed such that an inner space of each via hole can be increased while the spacing between adjacent via holes in the axial direction of a coil is prevented from being narrowed. In the via holes of the laminated coil, through-holes formed in ceramic layers and filled with a conductor are arranged in a row in the lamination direction X, and, in each of the through-holes, the difference between the diameter in the axial direction of the coil on the opening surface of one opening of a ceramic layer and the diameter in the axial direction of the coil on the opening surface of the other opening is smaller than the difference between the diameter in the direction Z that is substantially perpendicular to the axial direction Y of the coil on the opening surface of one opening of the ceramic layer and the diameter in the direction Z that is substantially perpendicular to the axial direction Y of the coil on the opening surface of the other opening.

20 Claims, 9 Drawing Sheets

LAMINATED COIL COMPONENT AND METHOD OF PRODUCING THE SAME

BACKGROUND OF THE INVENTION

1. Field of the Invention

The present invention relates to a laminated coil and a method for producing the laminated coil. More particularly, the present invention relates to the shape of via holes in a laminated coil and a method for forming such via holes.

2. Description of the Related Art

As an example of a laminated coil, a chip inductor disclosed in Japanese Unexamined Patent Application Publication No. 2002-252117 is widely known, and the construction of the chip inductor is shown in FIG. 9, and FIG. 10 is an exploded perspective view thereof. As shown in FIGS. 9 and 10, a related vertical lamination horizontal winding type chip inductor 11 has a structure in which a coil 13 wound in the direction Y, which is perpendicular to the lamination direction X of a laminated body 12, is disposed inside the laminated body 12. The coil 13 is constructed such that conductor patterns (belt-shaped conductors) 14 formed on laminated surfaces at fixed locations on the upper portion and the lower portion of the laminated body 12 are electrically connected through many via holes 15. Many of the via holes 15 are formed to extend in the lamination direction X.

That is, as shown in FIG. 10, these via holes 15 are formed such that through holes 17 are formed at fixed locations on each of ceramic green sheets 16 by laser radiation, etc., and these through-holes 17 are filled with a conductor such as conductor paste, etc. Then, as shown in FIGS. 11 and 12, each through-hole 17 has a substantially round flat shape and its inner surface has the same angle of inclination (taper angle) along the lamination direction X. Moreover, the ceramic green sheets 16 constitute ceramic layers in the laminated body 12.

FIG. 11 is a top view of the through-holes 17 and FIG. 12 shows the section of the through-holes 17 taken along line A—A in FIG. 11. That is, each through-hole 17 is constructed such that the diameter of the upper opening 17*b* is larger than the diameter of the lower opening 17*a*. Furthermore, the conductor patterns formed at the end portions on the upper surface of the laminated body 12 are lead to the end surfaces and connected to external electrodes 18 formed so as to cover the end surfaces of the laminated body 12, respectively.

On the other hand, when the laminated body 12 is produced, many of the ceramic green sheets in which only via holes are formed are disposed in the middle of the lamination direction X. Then, plural ceramic green sheets 16 in which conductor patterns 14 and via holes 15 are formed are disposed above and below the above-described ceramic green sheets 16. Furthermore, plural ceramic green sheets 16 in which no conductor patterns 14 or via holes 15 are formed are disposed above and below the above-described ceramic green sheets 16. Then, the ceramic green sheets 16 are attached by pressure in the lamination direction X and fired to obtain a laminated body 12. When the external electrodes 18 are formed on the end surfaces of the laminated body 12, a chip inductor 11 shown in FIG. 9 is completed.

In the chip inductor 11, since many via holes 15 are formed, the ratio of the resistance Rdc of the portion in which the via holes 15 are formed to the DC resistance value Rdc of the whole chip inductor 11 increases. It is not avoidable that the resistance Rdc of the whole element is affected. Thus, in order to prevent such a drawback, it is possible to consider that the flat shape of the via holes 15 is increased and, as a result, the inner volume of the via holes 15 is increased.

However, when the flat shape of the via holes 15 is simply increased, since the flat shape of the via holes 15 is substantially round, the spacing between adjacent via holes 15 in the axial direction of the coil 13 is narrowed. Furthermore, when the flat shape of the via holes 15 is made larger and the spacing between via holes 15 is appropriately kept, the number of turns of the coil 13 is reduced. As a result, a large impedance cannot be obtained.

SUMMARY OF THE INVENTION

In order to overcome the problems described above, preferred embodiments of the present invention provide a laminated coil in which, while the spacing between adjacent via holes in the axial direction of a coil is prevented from being narrowed, the inner space of each via hole can be increased, and also provide a method for producing such a novel laminated coil.

A laminated coil according to a preferred embodiment of the present invention includes via holes arranged to extend in a lamination direction of a laminated body, belt-shaped conductors disposed on laminating surfaces of the laminated body and fixed end portions of which are connected thereto by the via holes, and a coil wound in a direction that is substantially perpendicular to the lamination direction.

In the laminated coil, the via holes are formed in each ceramic layer constituting the laminated body and define through-holes, each being filled with a conductor, and arranged along a row extending in the lamination direction. In addition, in each through-hole, the difference between the diameter in the axial direction of the coil on the opening surface of one opening of the ceramic layer and the diameter in the axial direction of the coil on the opening surface of the other opening is smaller than the difference between the diameter that is substantially perpendicular to the axial direction of the coil on the opening surface of the one opening of the ceramic layer and the diameter that is substantially perpendicular to the axial direction of the coil on the opening surface of the other opening.

For example, in these through-holes, the inner portion corresponding to the axial direction of the coil has a greater angle of inclination in the lamination direction than the inner portion that is substantially perpendicular to both the axial direction of the coil and the lamination direction. In other words, the inner portion that is substantially perpendicular to both the axial direction of the coil and the lamination direction in each through-hole has a smaller angle of inclination in the lamination direction than the inner portion corresponding to the axial direction of the coil.

In a preferred embodiment of the present invention, each through-hole preferably has a substantially oval flat shape and a short-axis direction coincides with the axial direction of the coil.

A method for producing a laminated coil according to a preferred embodiment of the present invention includes the step of forming the via holes such that, after through-holes have been formed in accordance with the characteristics described above, the through-holes are filled with a conductor.

In the laminated coil according to a preferred embodiment of the present invention, in each through-hole constituting a via hole, the difference between the diameter in the axial direction of the coil on one opening surface of the ceramic layer and the diameter in the axial direction of the coil on the other opening surface is smaller than the difference between the diameter that is substantially perpendicular to the axial direction of the coil on one opening surface of the ceramic layer and the diameter that is substantially perpendicular to the axial direction of the coil on the other opening surface. That is, in the laminated coil, since the via holes in which the angle of inclination is different at each direction on the inner portion are formed, when compared with the via holes in which the angle of inclination is the same along the entire inner portion, the inner surface as a whole increases. As a result, the resistance Rdc of the portion where the via holes are formed is reduced.

Accordingly, the spacing between adjacent via holes in the axial direction of the coil is prevented from being narrowed and the number of turns of the coil can be effectively prevented from being reduced. As a result, it becomes possible to appropriately maintain the spacing between via holes and maintain the number of turns of the coil, and the ratio of the resistance Rdc of the portion where the via holes are formed decreases. Accordingly, a large impedance can be secured.

In the laminated coil of a preferred embodiment of the present invention, each through-hole constituting a via hole preferably has a substantially oval flat shape and the short-axis direction coincides with the axial direction of the coil. When such through-holes are used, the via holes described above can be easily formed as described above.

In the method for producing a laminated coil according to a preferred embodiment of the present invention, the angle of inclination on the inner portion of the through-holes can be easily controlled by adjustment of the energy distribution of laser light, and accordingly, the via holes described above can be easily formed.

Other features, elements, steps, characteristics and advantages of the present invention will become more apparent from the following detailed description of preferred embodiments thereof with reference to the attached drawings.

DETAILED DESCRIPTION OF PREFERRED EMBODIMENTS

In the present invention, it was made possible to prevent the spacing between via holes that are adjacent to each other in the axial direction of a coil from being narrowed and at the same time increasing the inner space of each via hole by establishing a three-dimensional structure of through-holes constituting via holes.

Figure 1:
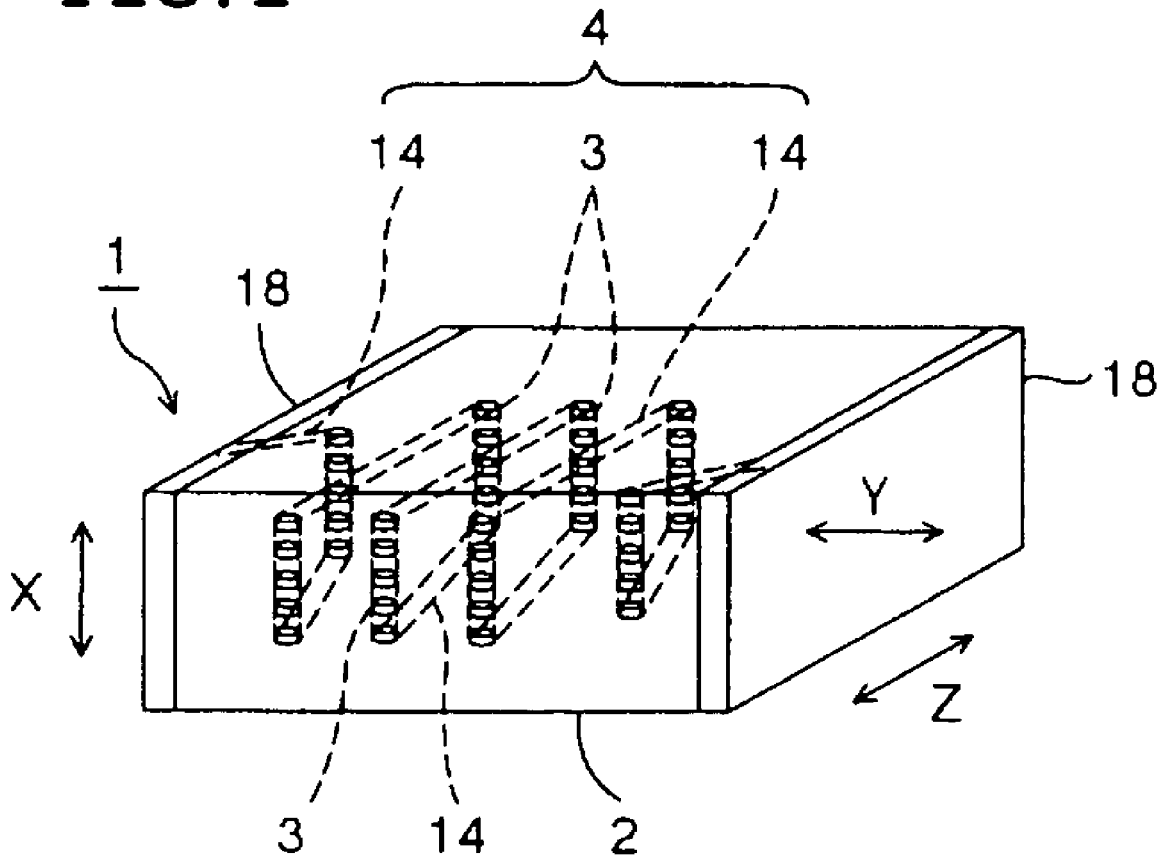
FIG. 1 is a perspective view showing the construction of a chip inductor according to a preferred embodiment of the present invention.
Figure 2:
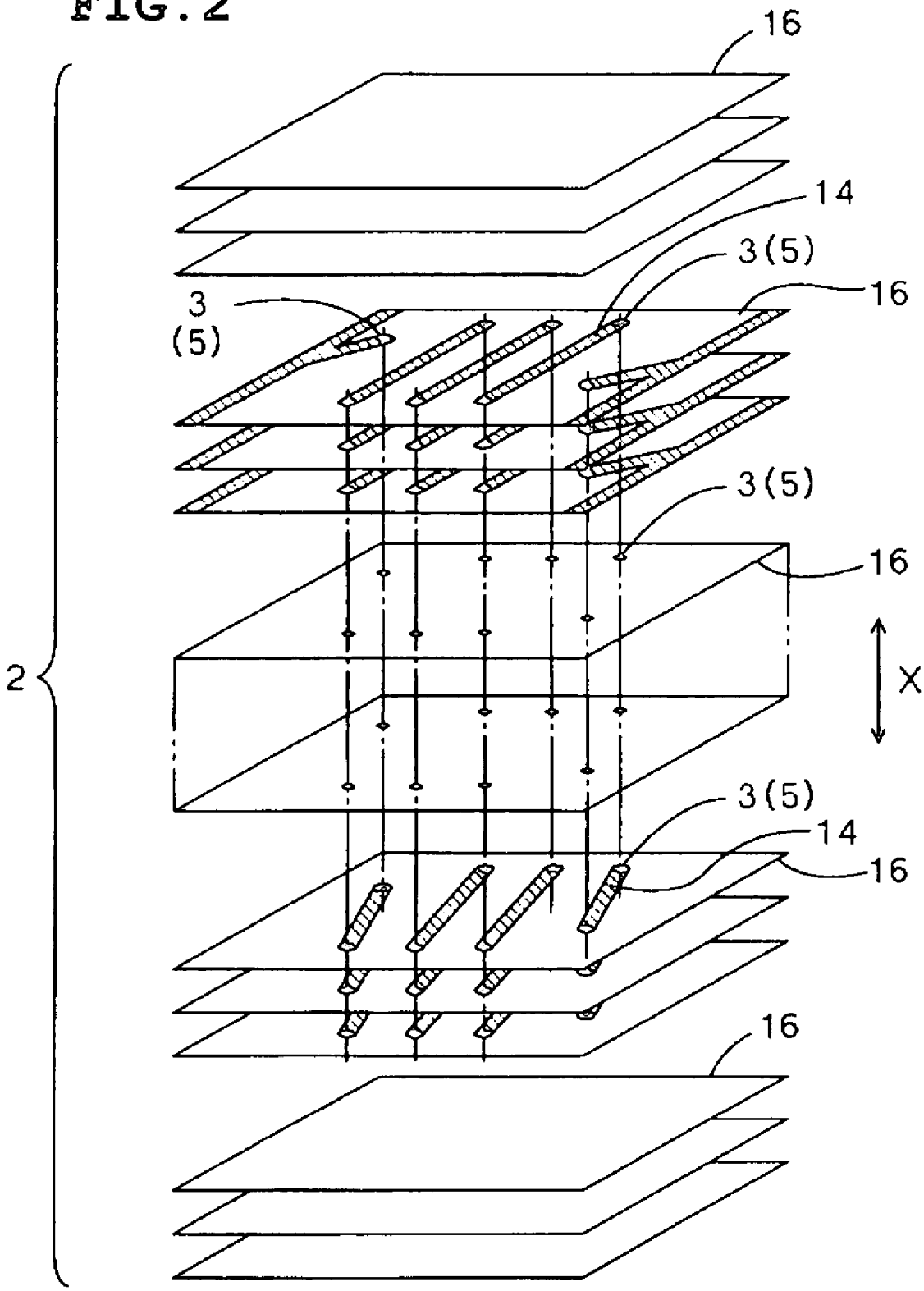
FIG. 2 is an exploded perspective view showing the construction of the chip inductor according to a preferred embodiment of the present invention.
Figure 3:
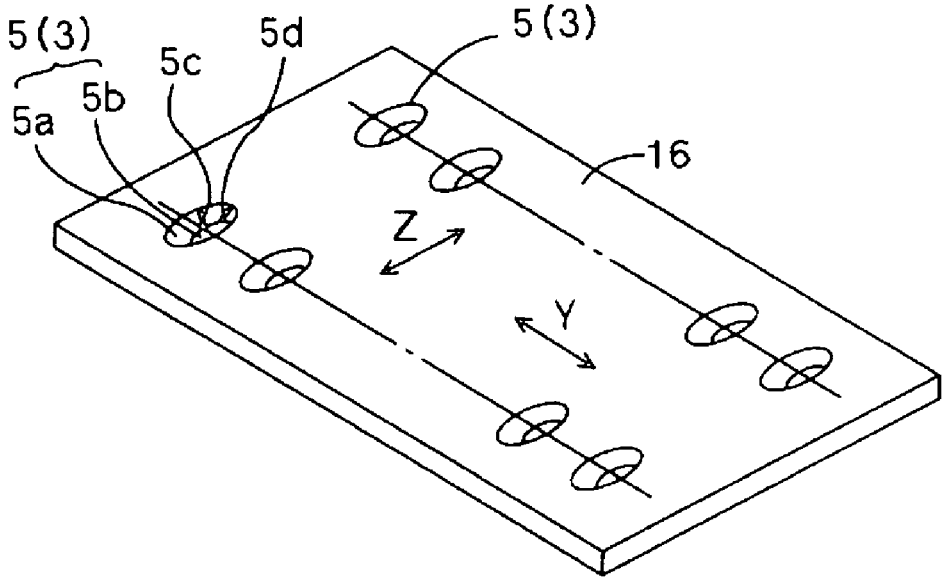
FIG. 3 is an enlarged perspective view showing through-holes constituting via holes of the chip inductor according to a preferred embodiment of the present invention.
Figure 4:
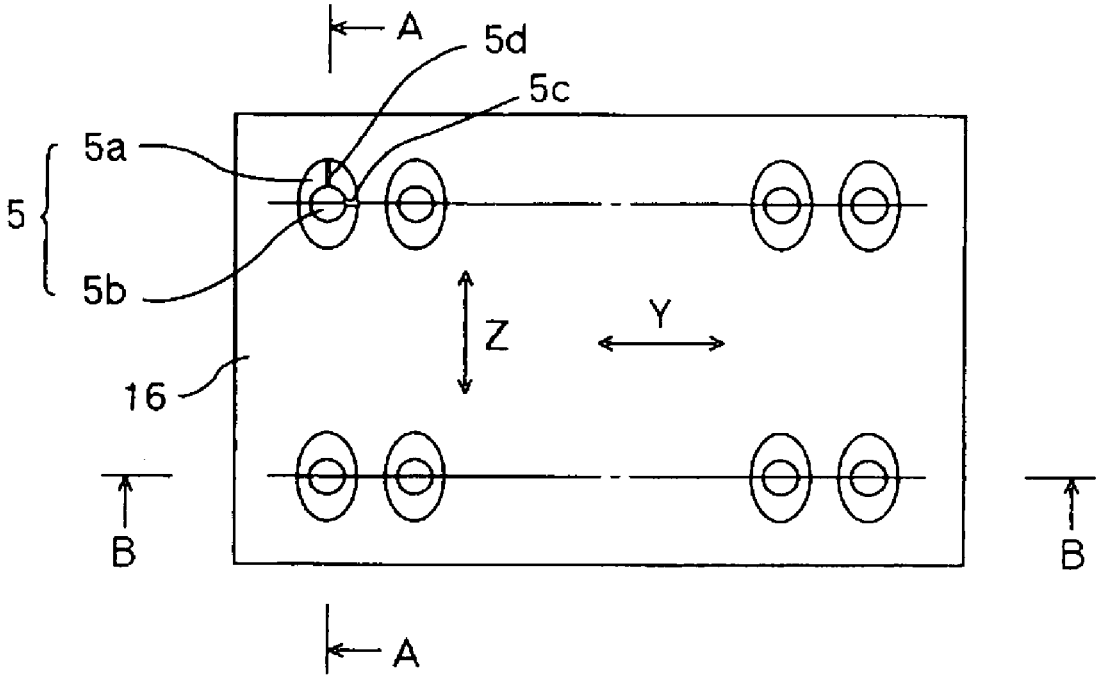
FIG. 4 is an enlarged top view showing the through-holes constituting the via holes of the chip inductor according to a preferred embodiment of the present invention.
Figure 5A:
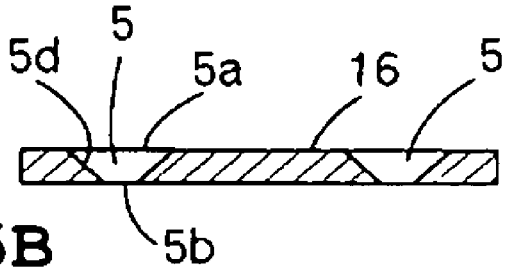
FIG. 5A is an enlarged sectional view, taken along line A—A in FIG. 4, showing the through-holes constituting the via holes of the chip inductor according to a preferred embodiment of the present invention.
Figure 5B:
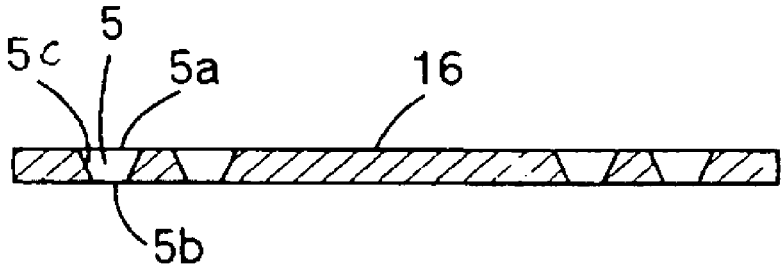
FIG. 5B is an enlarged sectional view, taken along line B—B in FIG. 4, showing the through-holes constituting the via holes of the chip inductor according to a preferred embodiment of the present invention.

FIG. 1 is a perspective view showing the construction of a chip inductor according to a preferred embodiment of the present invention, FIG. 2 is an exploded perspective view showing the construction of the chip inductor of the present preferred embodiment of the present invention, and FIG. 3 is an enlarged perspective view showing through-holes constituting via holes in the chip inductors of the present preferred embodiment of the present invention. Furthermore, FIG. 4 is an enlarged top view showing the through-holes constituting via holes, FIG. 5A is an enlarged sectional view showing through-holes taken along line A—A in FIG. 4, and FIG. 5B is an enlarged sectional view showing through-holes, taken along line B—B in FIG. 4.

Figure 6:
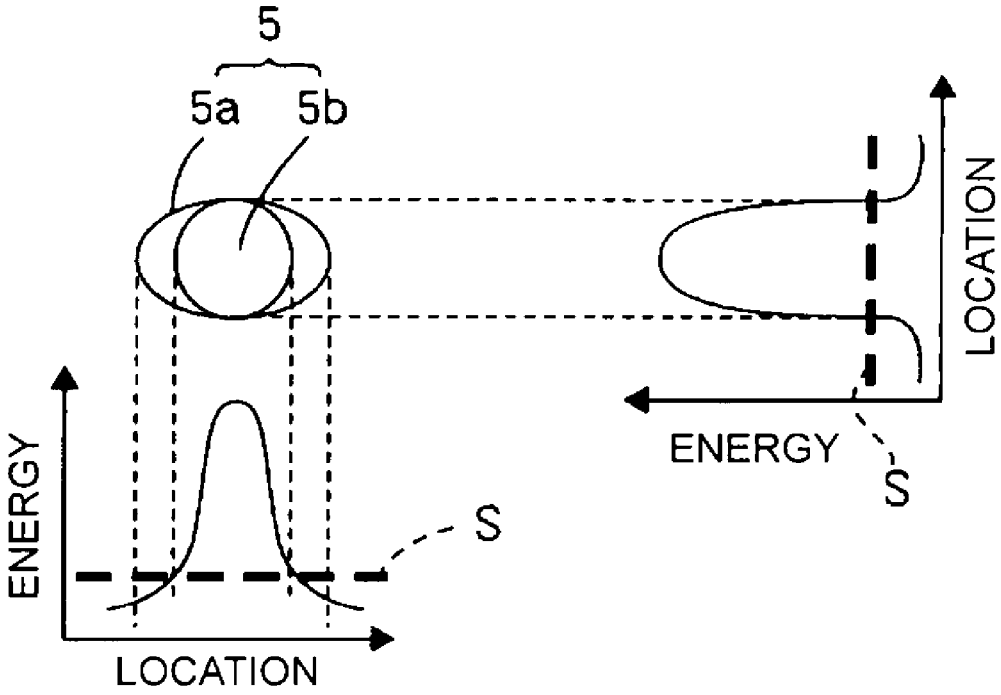
FIG. 6 is a diagrammatical view showing the relationship between a through-hole and the energy distribution of laser light according to a preferred embodiment of the present invention.
Figure 7:
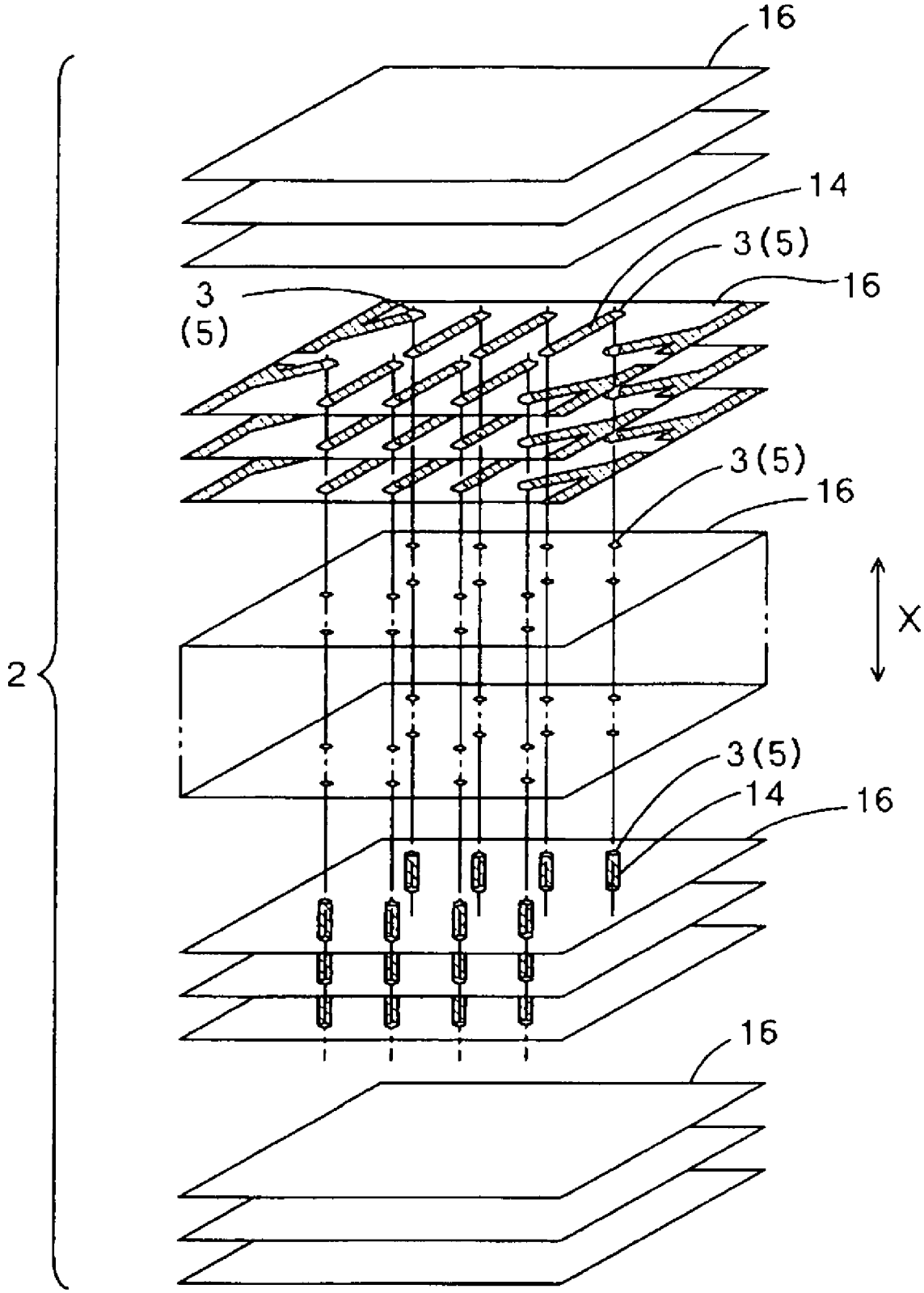
FIG. 7 is an exploded perspective view showing the construction of a chip inductor according to a first modified example of preferred embodiments of the present invention.
Figure 8:
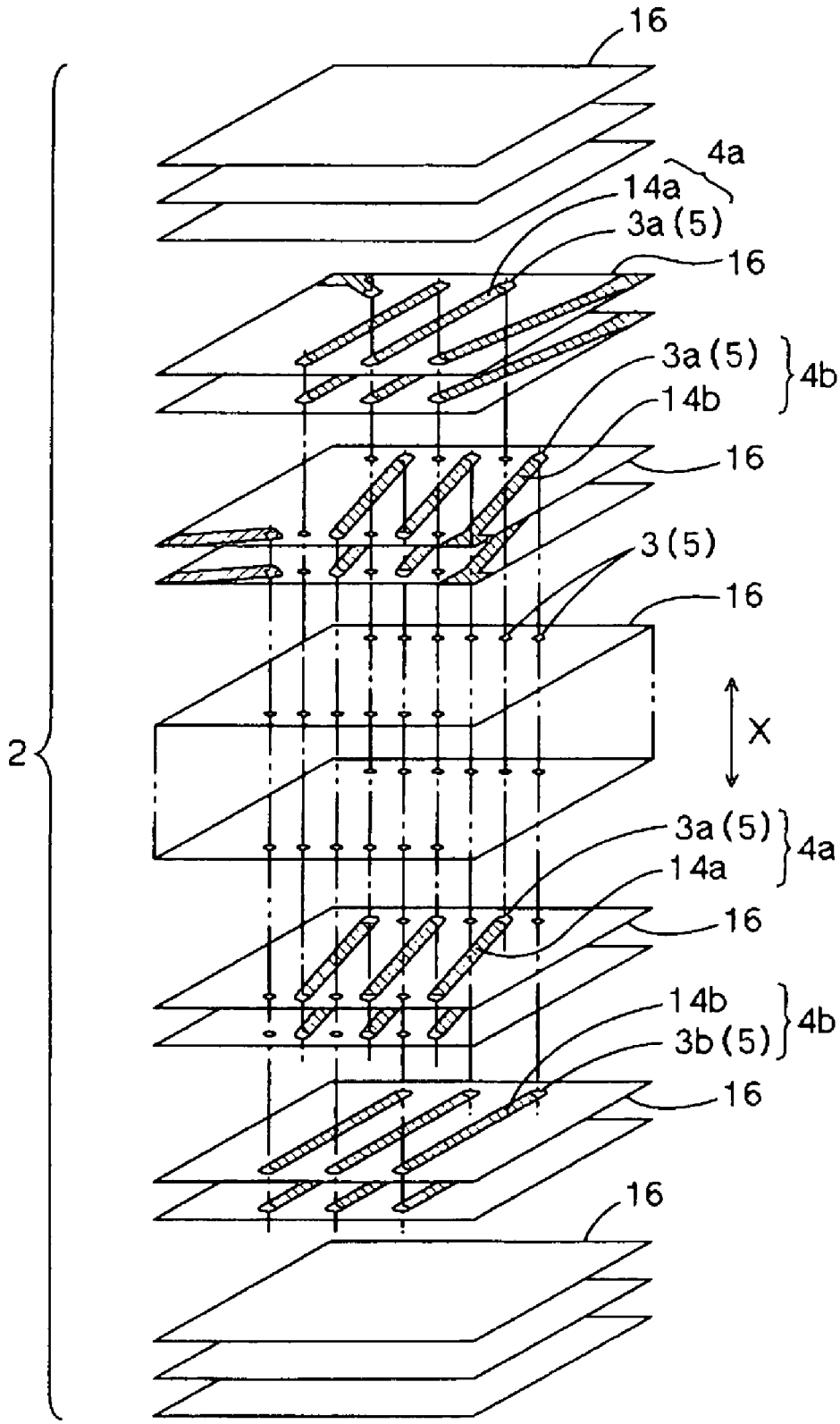
FIG. 8 is an exploded perspective view showing the construction of a chip inductor according to a second modified example of preferred embodiments of the present invention.
Figure 9:
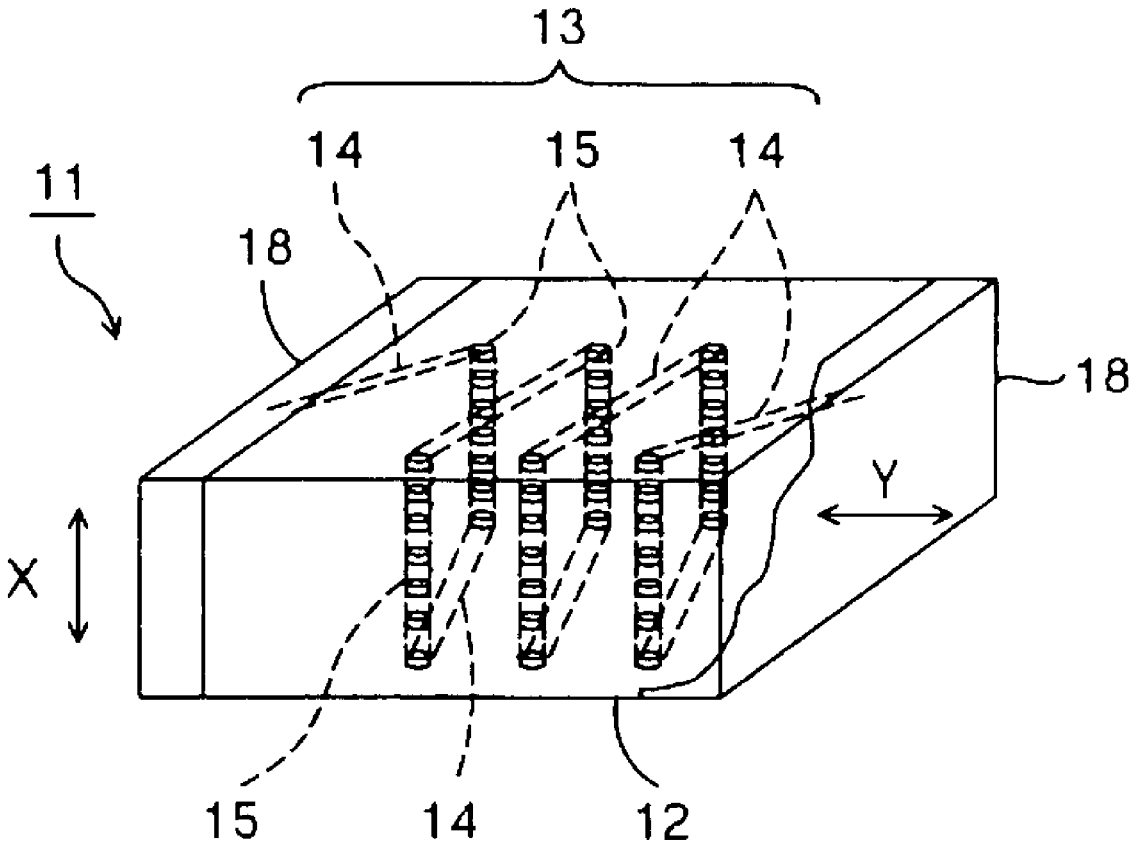
FIG. 9 PRIOR ART
FIG. 9 is a perspective view showing the construction of a chip inductor according to a related example.
Figure 10:
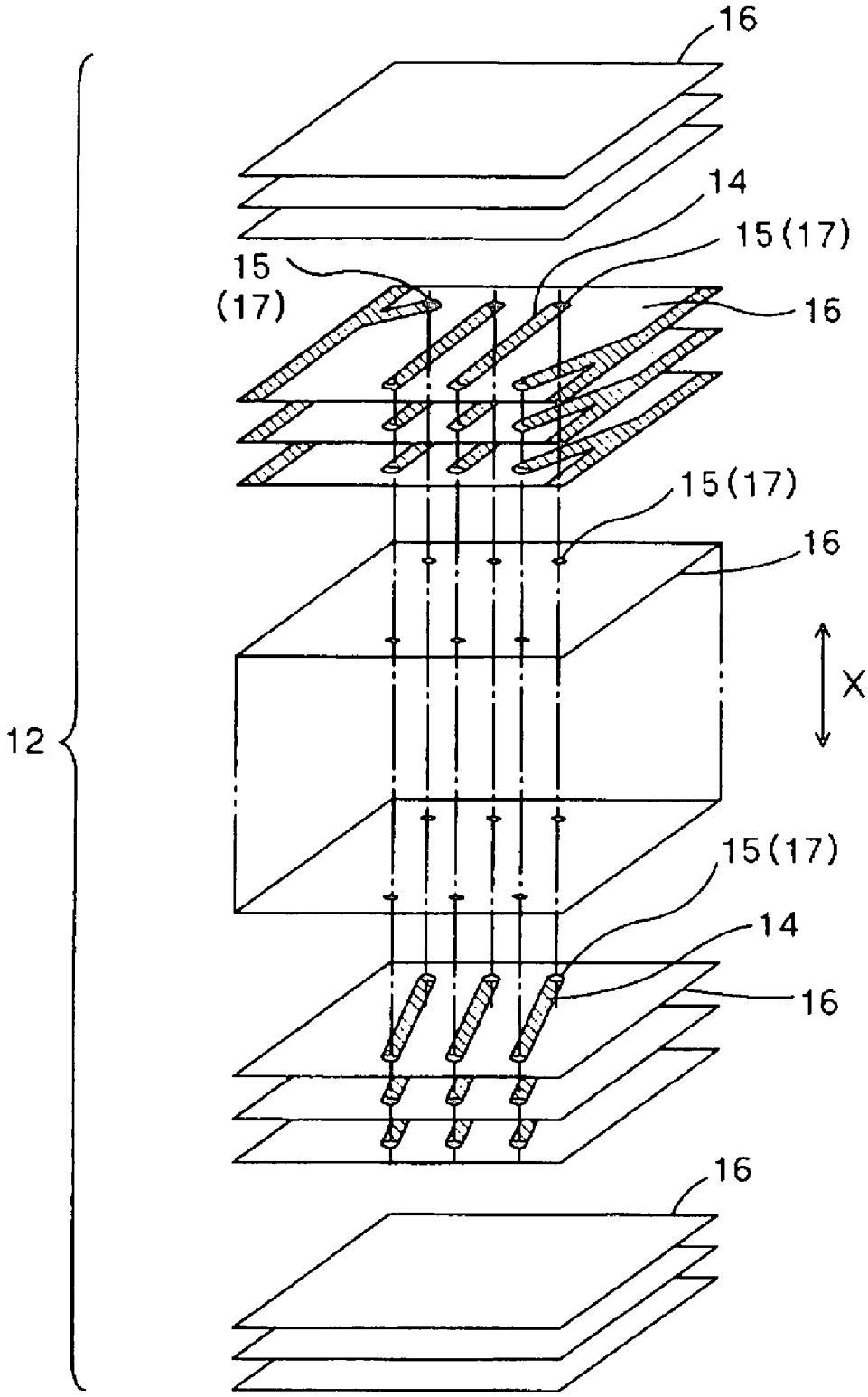
FIG.10 PRIOR ART
FIG. 10 is an exploded perspective view showing the construction of the chip inductor according to the related example.
Figure 11:
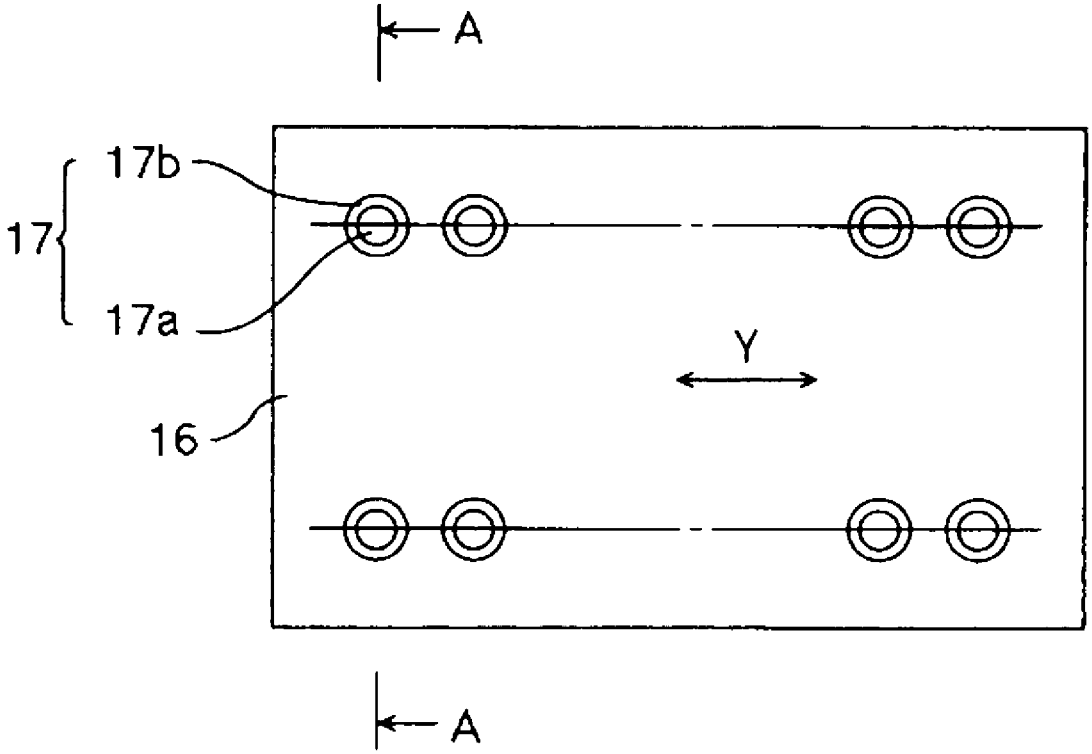
FIG.11 PRIOR ART
FIG. 11 is an enlarged top view showing through-holes constituting via holes of the chip inductor according to the related example.
Figure 12:
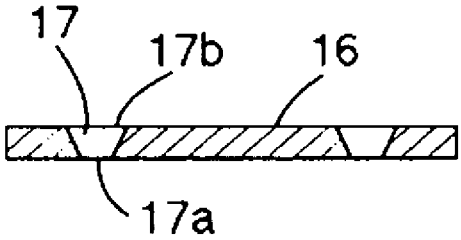
FIG.12 PRIOR ART
FIG. 12 is an enlarged sectional view, taken along line A—A in FIG. 11, showing the through-holes constituting the via holes of the chip inductor according to the related example.

Furthermore, FIG. 6 is a diagrammatical view showing the relationship between a through-hole and the energy distribution of laser light, FIG. 7 is an exploded perspective view showing the construction of a chip inductor according to a first modified example of preferred embodiments of the present invention, and FIG. 8 is an exploded perspective view showing the construction of a second modified example of preferred embodiments of the present invention. Moreover, in FIGS. 1 to 8, the same elements as in FIGS. 9 to 12, are indicated by the same reference numerals.

As shown in FIGS. 1 and 2, a chip inductor 1 according to a preferred embodiment of the present invention includes via holes 3 formed to extend in a lamination direction of a laminated body 2 and conductor patterns (e.g., preferably, belt-shaped conductors) 14 in which fixed end portions are connected thereto by the via holes 3. In the laminated body 2 of the chip inductor 1, a coil is constructed by the via holes and the conductor patterns disposed along the laminated surfaces of the laminated body 2 and connected to the via holes.

That is, the coil 4 of the chip inductor 1 is constructed such that conductor patterns (belt-shaped patterns) 14 located on the laminated surfaces at fixed locations on the upper portion and the lower portion of the laminated body 2 are electrically connected through many via holes 3 extending in the lamination direction X. At this time, the conductor patterns 14 disposed at the end portions of the laminated surfaces on the upper portion of the laminated body 2 are lead out to the end surfaces of the laminated body 2, respectively, and the conductor patterns 14 are separately connected to external electrodes 18, which are arranged so as to cover the end surfaces of the laminated body 2. Moreover, in FIG. 2, each of the conductor patterns 14 is preferably constituted by three layers, but the conductor patterns 14 may be constituted by one layer or other numbers of layers.

On the other hand, as shown in FIG. 2, the via holes in this case are formed such that through-holes 5 are formed preferably by laser radiation, etc., at fixed locations of each of ceramic green sheets 16 defining ceramic layers of the laminated body 2 and the conductor-holes 5 are filled with a conductor such as conductor paste, etc. Furthermore, at this time, as shown in FIGS. 3 and 4, the through-holes 5 preferably have an oval flat shape and a long-axis direction thereof is a direction Z that is substantially perpendicular to both the axial direction of the coil and the lamination direction X of the laminated body 2.

Moreover, in FIGS. 3 and 4, only the upper openings 5*a* in the through-holes 5 formed in the ceramic green sheets 16 preferably have a substantially oval flat shape. The lower openings 5*b* in the through-holes 5 in the ceramic green sheets 16 preferably have a round flat shape. However, the through-holes 5 are not limited to such a construction. The lower opening 5*b* of each through-hole 5 may have a substantially oval flat shape, and it is desirable that the lower opening 5*b* also have a substantially oval flat shape in order to reduce the resistance Rdc in the portion where the via holes are formed.

In this case, as shown in FIGS. 3 to 5, in the through-holes 5, there is provided a difference between the diameter in the axial direction of the coil 4 in one opening, that is, in the opening surface of the upper opening 5*a* of the ceramic green sheet 16 and the diameter in the axial direction of the coil 4 in the other opening, that is, in the opening surface of the lower opening 5*b*. The difference is preferably smaller than a difference between the diameter in the opening surface of the upper opening 5*a* in the direction Z that is substantially perpendicular to both the axial direction Y of the coil 4 and the lamination direction X and the diameter in the opening surface of the lower opening 5*b* in the direction Z that is substantially perpendicular to the axial direction Y of the coil 4 and the lamination direction X.

That is, in the through-holes 5, the inner portion 5*c* corresponding to the axial direction Y of the coil 4 has a greater angle of inclination (taper angle) than the inner portion 5*d* corresponding to the direction Z that is substantially perpendicular to both the axial direction Y of the coil 4 and the lamination direction X of the laminated body 2. In other words, in the through-holes 5, the inner portion 5*d* in the direction that is substantially perpendicular to both the axial direction Y of the coil 4 and the lamination direction X has a smaller angle in the lamination direction X than the inner portion 5*c* in the axial direction Y of the coil 4.

In the case of the through-holes 5 having such a three-dimensional shape, when compared with the through-holes 17 having the three-dimensional shape shown in the related example, the inner surface increases as a whole and the inner volume also increases. Then, in the chip inductor 1 where the via holes 3 having the through-holes 5 filled with a conductor therein are provided, the resistance Rdc of the portion having a via hole 3 formed therein is smaller than that in the chip inductor 11 shown in the related example. As a result, the ratio of the resistance Rdc in the portion where the via holes are formed relative to the whole resistance Rdc of the chip inductor 1 decreases.

Next, a method for producing a chip inductor 1 according to another preferred embodiment of the present invention is described. First of all, an aqueous binder such as polyvinyl acetate and water-soluble acrylic resin or an organic binder such as polyvinyl butyral is added to NiCuZn ferrite as a magnetic material. A dispersant, an antifoaming agent, etc., are added together with that, and then, a ceramic green sheet 16 is formed on a carrier film by using a doctor-blade coater and a reverse-roll coater.

In succession, through-holes 5 are formed at fixed locations on the ceramic green sheets by laser radiation. Then, as shown in FIG. 6, a through-hole 5 having a substantially oval flat shape, for example, a through-hole 5 having a substantially oval upper opening 5*a* and a substantially round lower opening 5*b* is formed by adjustment of the energy distribution of laser light. That is, at this time, when the energy of laser light exceeds a threshold value S, a hole passing through the ceramic green sheet is formed, and, if the energy rapidly changes around the time when the energy exceeds the threshold value S, the angle of inclination on the inner surface of the through-hole 5 decreases. Furthermore, if the energy slowly changes around the time when the energy exceeds the threshold value S, the angle of inclination on the inner surface of the through-hole 5 increases.

When it is assumed that, in a chip inductor 1 having a 3216 size, the number of turns of the coil 4 is 25.5 and the through-holes 5 having the upper opening 5*a* and the lower opening 5*b*, both having a substantially oval flat shape, are formed, the following dimensions are obtained. Although not illustrated, the dimension in the long-axis direction of the upper opening 5*a* of the through-hole 5, that is, in the direction that is substantially perpendicular to both the axial direction Y of the coil 4 and the lamination direction X is about 150 μm. The dimension in the short-axis direction, that is, in the short-axis direction corresponding to the axial direction Y of the coil 4 is about 90 μm. Furthermore, the dimension in the long-axis direction of the lower opening 5*b* of the through-holes 5 is about 110 μm and the dimension in the short-axis direction is about 80 μm.

When constructed in this way, the dimension in the short-axis direction of the through-holes constituting the via holes which are filled with a conductor may be made smaller. Therefore, the cases where the spacing between adjacent via holes 3 in the axial direction Y of the coil 4 becomes too small do not occur, and the outer dimensions of the laminated body 2 do not become too large. Furthermore, in the chip inductor 1 having a 3216 size, when the number of turns of 25.5 is secured, the maximum dimension in the short-axis direction of the upper opening 5*a* of the through-holes 5 is about 90 μm. That is, when the dimension in the short-axis direction of the upper opening 5*a* of the through-holes 5 increases, a short circuit is likely to occur because of diffused silver, cracks, etc., after sintering.

Next, a conductor paste having silver as the main component is prepared and the via holes 3 are formed such that the through-holes 5 formed in the ceramic green sheet 16 are filled with the conductor by screen printing of the conductor paste. Then, conductor patterns 14 constituting a portion of the coil 4 are formed at fixed locations on the surface of the ceramic green sheets 16. After that, as shown in FIG. 2, a fixed number of ceramic green sheets 16 in which only via holes 3 are formed are disposed in the middle of the lamination direction X. A fixed number of ceramic green sheets 16 in which via holes 3 and conductor patterns 14 are formed are disposed above and below the ceramic green sheets 16, respectively.

Furthermore, a fixed number of ceramic green sheets 16 in which any of via holes 3 and conductor patterns 14 are not formed are disposed in layers above and below the ceramic green sheets 16, respectively, and then, after they have been attached by pressure in the lamination direction, they are cut so as to have fixed dimensions, they are degreased, and they are fired to obtain a laminated body 2. After that, paste is fired on both end surfaces of the laminated body 2, and both end surfaces are plated with nickel and tin to form external electrodes 18, and then, as shown in FIG. 1, a chip inductor 1 is completed.

In this preferred embodiment of the present invention, the chip inductor 1 in which one coil 4 is provided inside the laminated body 2 is a laminated coil, but the application of the laminated coil of the present invention is not limited only to the above-described chip inductor 1. That is, a chip inductor, the structure of which is shown in FIG. 7, that is, in which two coils 4 are provided in parallel in the laminated body 2, is used as transformers and common mode choke coils. Such a chip inductor having two separate windings may be made into a laminated coil.

Furthermore, the present invention may be applied to a chip inductor, the structure of which is shown in FIG. 8, that is, in which two coils 4*a* and 4*b*, alternately disposed in the lamination direction X, are provided in the laminated body 2. The chip inductor is constituted by alternate windings. That is, in the chip inductor, the first coil 4*a* is constituted by conductor patterns 14*a* and via holes 3*a* (shown by a one-dot chain line in FIG. 8), and the second coil 4*b* is constituted by conductor patterns 14*b* and via holes 3*b* (shown by a two-dot chain line in FIG. 8). The coupling coefficient between the two coils 4*a* and 4*b* in such a chip inductor of alternate windings is larger than that in the chip inductor of separate windings.

Then, in such a chip inductor of alternate windings, since many via holes 3 are aligned in the length direction of the laminated body 2, the reduction in the resistance Rdc because of the application of the present invention is remarkable.

A laminated coil according to various preferred embodiments of the present invention can be applied to laminated coils such as chip inductors, lamination type composite LC components, etc.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

The invention claimed is:

1. A laminated coil comprising:

a laminated body;

via holes formed in a lamination direction of said laminated body;

conductors disposed on laminating surfaces of the laminated body and fixed end portions of which are connected thereto by the via holes; and a coil wound in a direction that is substantially perpendicular to the lamination direction; wherein the via holes are disposed in each ceramic layer constituting the laminated body and define through-holes, each being filled with a conductor material and arranged along a row in the lamination direction; and in each of the through-holes, a difference between a diameter in an axial direction of the coil on an opening surface of one opening of the ceramic layer and a diameter in the axial direction of the coil on an opening surface of another opening is smaller than a difference between a diameter in a direction that is substantially perpendicular to the axial direction of the coil on the opening surface of said one opening of the ceramic layer and a diameter in a direction that is substantially perpendicular to the axial direction of the coil on the opening surface of said another opening.

2. A laminated coil as claimed in claim 1, wherein each of the through-holes has a substantially oval flat shape and a short-axis direction corresponds with the axial direction of the coil.

3. A laminated coil as claimed in claim 1, wherein the laminated coil defines a chip inductor.

4. A laminated coil as claimed in claim 1, wherein the conductors on the laminating surfaces of the laminated body are substantially belt-shaped.

5. A laminated coil as claimed in claim 1, wherein the conductors are defined by at least one conductor layer.

6. A laminated coil as claimed in claim 1, wherein the conductors are defined by at least three conductor layers.

7. A laminated coil as claimed in claim 1, wherein each of the through-holes has an upper opening having a substantially oval flat shape and a lower opening having a substantially round flat shape.

8. A laminated coil as claimed in claim 1, wherein each of the through-holes has an upper opening having a substantially oval flat shape and a lower opening having a substantially oval flat shape.

9. A laminated coil as claimed in claim 1, wherein each of the through-holes has a first inner portion corresponding to the axial direction of the coil having a greater angle of inclination than a second inner portion corresponding to the direction that is substantially perpendicular to both the axial direction of the coil and the lamination direction of the laminated body.

10. A laminated coil as claimed in claim 1, wherein two coils are provided in parallel in the laminated body.

11. A laminated coil as claimed in claim 10, wherein the laminated coil defines one of a chip inductor, a transformer and a common mode choke coil.

12. A method for producing a laminated coil, comprising the steps of:

forming a plurality of ceramic green sheets;

forming conductors on surfaces of the ceramic green sheets; and laminating the plurality of ceramic green sheets in a lamination direction to form a laminated body;

forming via holes in the ceramic green sheets such that in each of the through-holes, a difference between a diameter in an axial direction of the coil on an opening surface of one opening of the ceramic layer and a diameter in the axial direction of the coil on an opening surface of another opening is smaller than a difference between a diameter in a direction that is substantially perpendicular to the axial direction of the coil on the opening surface of said one opening of the ceramic layer and a diameter in a direction that is substantially perpendicular to the axial direction of the coil on the opening surface of said another opening; and after through-holes have been formed, filling the through-holes with a conductor material so as to form a coil wound in a direction that is substantially perpendicular to the lamination direction.

13. The method according to claim 12, wherein the through holes are formed via laser radiation.

14. The method according to claim 13, wherein an energy distribution of laser light is adjusted during the laser radiation such that each of the through holes has an upper opening having a substantially oval flat shape and a lower opening having a substantially round flat shape.

15. The method according to claim 13, wherein an energy distribution of laser light is adjusted during the laser radiation such that each of the through holes has a first inner portion corresponding to the axial direction of the coil having a greater angle of inclination than a second inner portion corresponding to the direction that is substantially perpendicular to both the axial direction of the coil and the lamination direction of the laminated body.

16. The method according to claim 12, wherein each of the through holes is formed such that each of the through-holes has a substantially oval flat shape and a short-axis direction corresponds with the axial direction of the coil.

17. The method according to claim 12, wherein each of the through holes is formed such that each of the through-holes has an upper opening having a substantially oval flat shape and a lower opening having a substantially oval flat shape.

18. The method according to claim 12, wherein the laminated coil defines a chip inductor.

19. The method according to claim 12, wherein two coils are formed in parallel in the laminated body.

20. The method according to claim 19, wherein the laminated coil defines one of a chip inductor, a transformer and a common mode choke coil.

* * * * *